US006199353B1

(12) United States Patent
Chladek et al.

(10) Patent No.: US 6,199,353 B1
(45) Date of Patent: Mar. 13, 2001

(54) ANIMAL CONTROL HALTER

(76) Inventors: Jim M. Chladek, 3161 Monte Vista, Casper, WY (US) 82601; Sterling White, R.R. 1 Box 155, Goodman, MO (US) 64843

( * ) Notice: Subject to any disclaimer, the term of this patent is extended or adjusted under 35 U.S.C. 154(b) by 0 days.

(21) Appl. No.: 09/417,463

(22) Filed: Oct. 12, 1999

(51) Int. Cl.[7] ..... B68B 1/02
(52) U.S. Cl. ..... 54/24
(58) Field of Search ..... 54/6.2, 13, 24, 54/69; 119/795

(56) References Cited

U.S. PATENT DOCUMENTS 4,324,089 4/1982 Hart et al. ..... 54/24
4,337,610 * 7/1982 Taylor ..... 54/24
4,589,248 5/1986 Ruddock et al. ..... 54/24
5,086,611 * 2/1992 Purdy ..... 54/24
6,062,005 * 5/2000 Roberts ..... 54/24

* cited by examiner

*Primary Examiner*—Charles T. Jordan
*Assistant Examiner*—Elizabeth Shaw

(57) ABSTRACT

An animal control halter includes rigid co-acting sides with protrusions positioned to exert inward pressure on the nose of an animal at its tear bone. The sides are connected through a resilient bridge on one end, and by a control line at the other. The control line is secured on one side, looped through the other side, and back through the first side, and extends therefrom. When tension is applied on the control line, the sides are pulled together, against the bias of the bridge, to apply pressure on the animal's nose and teir bone. Upon slackening the control line, pressure is removed by the bridge bias. Harness straps are used to secure the halter to the animal.

8 Claims, 4 Drawing Sheets

ANIMAL CONTROL HALTER

BACKGROUND OF THE INVENTION

1. Field of the Invention

The present invention relates to animal training devices. More specifically, the present invention relates to a control halter used to train animals.

2. Description of the Prior Art

Through the use of various aids, a handler can maintain remarkable control over a well-trained and well-behaved animal. Aids include cues given through touch and sound, and may be transmitted from a handler to the animal in the form of voice commands, weight shifts, as well as through harness tack, such as halters, bridles, saddles, and stirrups for horses. To train an animal to these aids, conditioning through a lengthy training process is typically required. However, in the training process as well as under duress, an animal may not respond as conditioned. In these situations, the animal may become dangerous to the handler and to itself, if control is not quickly gained.

There have been prior devices for controlling animals by applying pressure to various sensitive parts of an animal. Among the most ubiquitous is a bit, typically a metal bar, positioned in the animal's mouth. Bits are connected to reins which may be tensioned to place pressure on the bars mouth.

Other devices are designed to press downward on a portion of the animal's head. For example, U.S. Pat. No. 4,589,248, issued May 20, 1989 to W. Ruddock et al., describes a horse training halter having a cover that includes a hollow nose section and two hollow side sections. A cable is passed through the cover, and attached to pulleys at each end. A separate control line runs through each pulley. This halter exerts downward pressure on the horses nose upon pulling one or both of the control lines. As can be seen from the patent drawings, this device is designed for use while a handler is mounted on the horse to control both lines, similar to a bit and reins configuration.

U.S. Pat. No. 4,324,089, issued Apr. 13, 1982 to L. Hart et al. describes a control leader that includes brow and crown members looped over the ears of a horse, and a flexible leader member attached to the brow and crown members to hang freely therefrom. Downward pressure may be exerted on a horsels head from the brow and crown members through the leader member. This allows a handler to exert control while dismounted. Unfortunately, the handler must position himself or herself below and quite close to the animal to provide the downward component of force necessary to manipulate the leader properly, thereby exposing the handler to injury.

SUMMARY OF THE INVENTION

The present invention allows a handler to exert controlling force while maintaining a safe distance from the animal. Accordingly, less risk of injury is posed to the handler in the use of the present halter when compared to those of the prior art. Further, pressure is applied between co-acting parts fitted to the animal's head through a single control line. Therefor, the relative position of the animal's head to the handler is of negligible consequence. This provides greater flexibility than previously available, and allows the halter to be used in training steps such as longing, without necessitating harsh artificial aids such as whips.

To accomplish this, the present invention provides a halter including a device that allows pressure to be exerted to a sensitive nose portion of an animal's head through a squeeze force between co-acting nose engaging portions on two side pieces of the device. The side pieces are substantially rigid and may have be curved to provide the overall device with an outwardly bowing configuration to more easily accommodate the animal's head. Nose engaging portions are provided as inward protrusions to be positioned under the tear bone of the animal.

The halter further includes a resilient bridging member between the side pieces which is fitted over the nose of the animal such that the side pieces extend down and under the animal's head. The bridging member biases the two side pieces to a position such that the nose engaging sections overlie the animal's nose without applying any discomforting pressure thereto. The resilient bridging member may include an arched spring wire or an arched spring band, preferably of metal construction. The bridging member may also include rigid sections, as long as resilient sections are provided for connecting the side pieces.

A control line interconnects the side pieces under the animal's head such that pull applied to the control line urges the pieces together, against the bias of the bridging member. The control line has a first end and second end. The first end is secured to one of the side pieces, and the second end is looped through the other side piece in one or more grommets or holes provided therein or thereon, and back through the first piece. The free second end of the control line may then be tensioned by pulling, which translates to a squeezing action where the side pieces are urged towards each other. When tension is removed on the control line, the resilient bridging member returns the device to its original position, and the squeezing force on the animal's nose is removed.

The device of the present invention may be secured to a conventional harness for placement on the animal. Alternatively, the device may include tack for independently securing it in place. To accomplish this, a harness strap may be attached at one end to one side piece and at the other end to the other side piece such that the nose engaging portions of the side pieces are disposed on opposing sides of the animal's nose proximate its tear bone with the harness strap forming a loop sized to engage the back of the animal's head. The harness strap may include multiple strap sections securable together to provide adjustability for accommodating different animal sizes. One or more strap section may accordingly include a fastener such as a buckle, and another section a plurality of fastening positions, such as buckle holes.

Accordingly, it is a principal object of the invention to provide a harness equipped with a device for taming and/or controlling an animal that allows squeeze pressure to be exerted on the animal's nose.

It is another object of the invention to provide such a harness which may be manipulated through a single control line at safe lateral distances from the animal.

It is a further object of the invention to provide a harness that may be used in training or breaking steps in lieu of harsh artificial aids such as whips.

Still another object of the invention is to provide a harness with a device of simple and inexpensive construction which is fully effective in carrying out the other objects.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
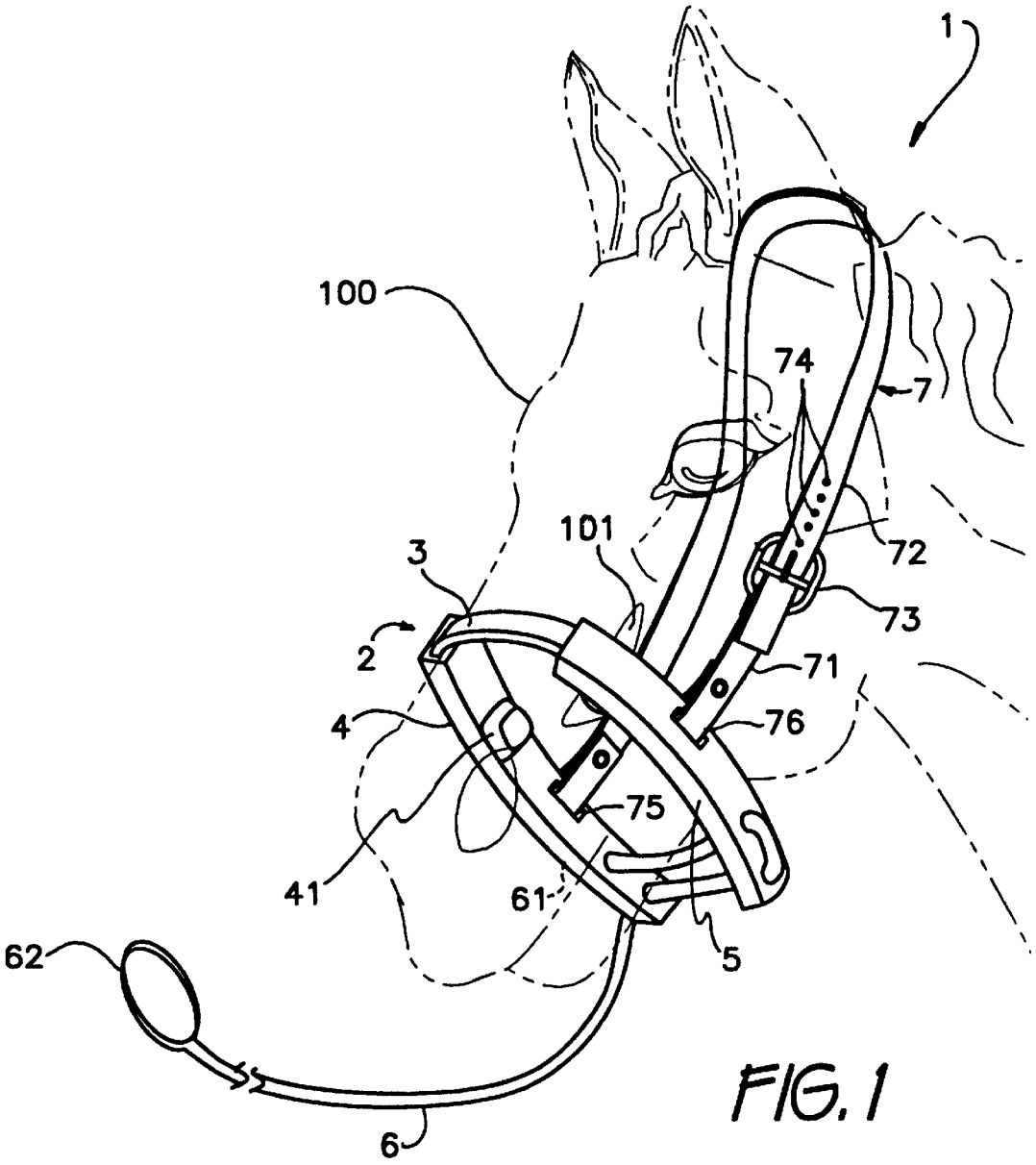
FIG. 1 is an environmental view of one embodiment of the present animal control halter.

The present invention relates to a halter 1, as best shown in FIG. 1, that includes a control device 2 having a resilient bridging member 3 connecting a first side piece 4 to a second side piece 5. Nose engaging portion 41 of the first side piece, and a corresponding nose engaging portion 51 of the second side piece, are provided for engaging opposite sides of the nose of an animal at an area proximate the tear bone 101, such as that of the horse 100. A control line 6 is secured at a first end 61 to the first side piece 4, courses through the second side piece 5, back through the first side piece, and extends to a second end 62. When tension is applied to the control line, the length interconnecting the side pieces is decreased, and the side pieces are urged together.

Figure 2:
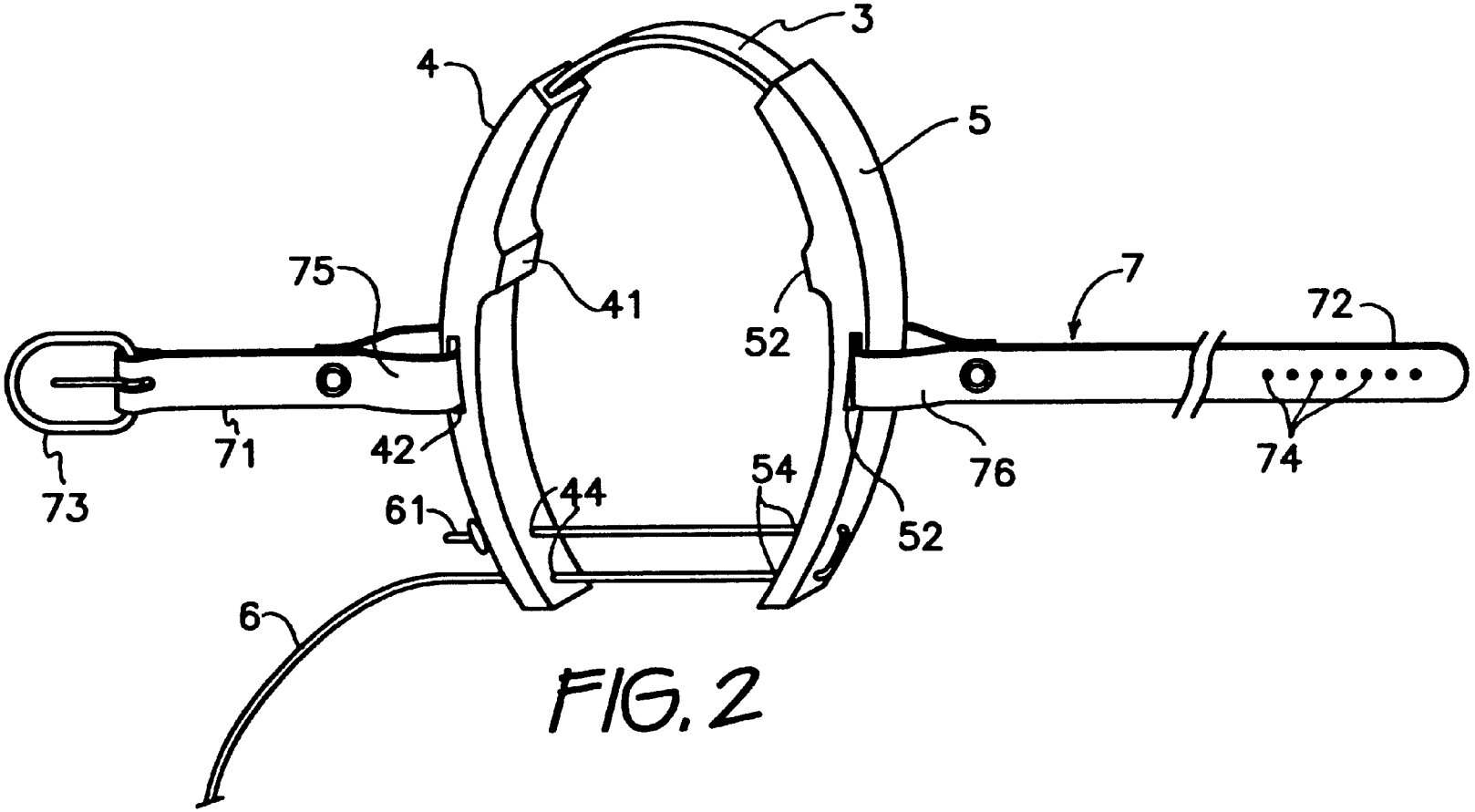
FIG. 2 is a frontal perspective view of another embodiment of the present animal control halter.
Figure 3:
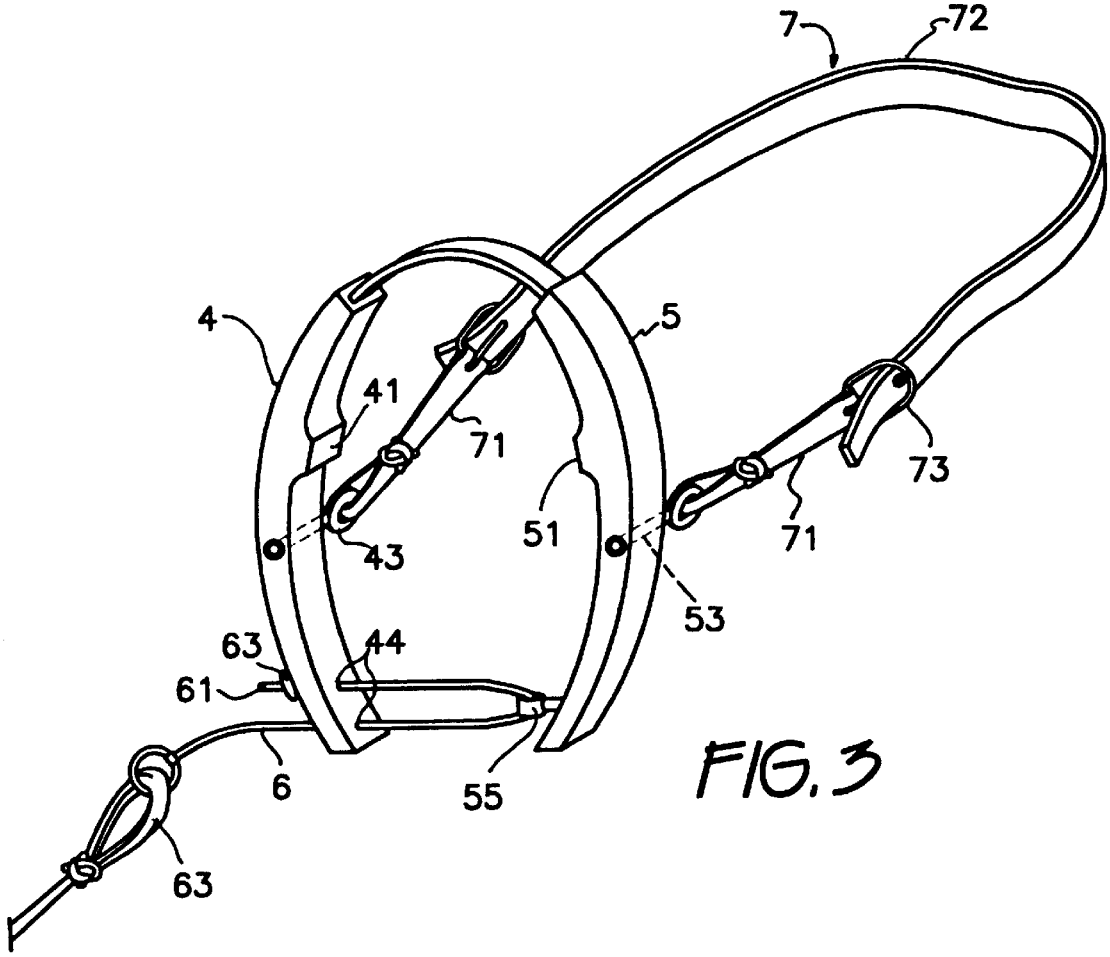
FIG. 3 is a frontal perspective view of yet another embodiment of the present animal control halter.
Figure 4:
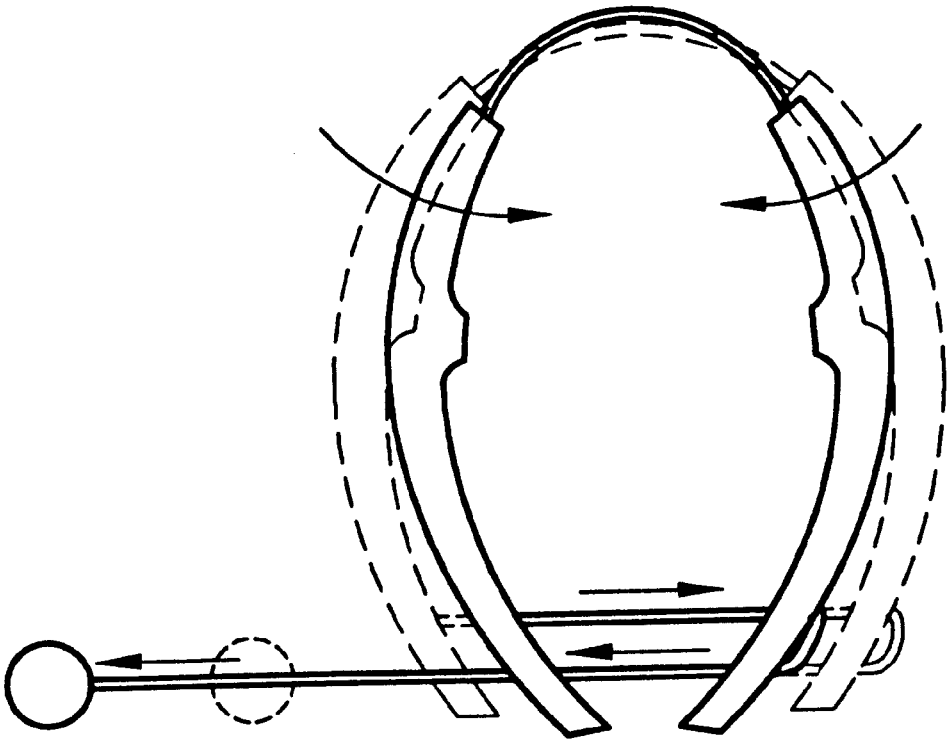
FIG. 4 is a schematic front view showing relative positions of various elements of the present animal control halter under tension and at rest.

The side pieces 4 and 5 are substantially rigid, and are preferably each of unitary wooden or other materials construction. The connecting bridging member 3 is preferably of a metal, selected with sufficient flexibility to allow the connected side pieces to be relatively moved, yet with sufficient resiliency to return the device to substantially it's original configuration, as shown in dotted lines by FIG. 4. As shown in FIG. 2, side pieces 4 and 5 may be curved towards each other to conform with a horse's head, and a short bridging member 3 is used. Here a spring wire secured at each end to the side pieces is shown. Alternatively, as shown in FIG. 3, the side pieces 4 and 5 are connected by a longer bridging member 3, here comprising a spring band. Since head curvature is substantially accommodated by the bridging member, side pieces are straighter than the embodiment of FIG. 2.

To secure the device 2 to the horse's head, a harness strap 7 may be provided, as shown in FIG. 1, or the device may be attached to conventional tack such as a pre-existing halter or harness (not shown). Harness strap 7 may include multiple sections, such as 71 and 72, adjustably connected together by a fastener such as the buckle 73 and buckle holes 74. As shown in FIG. 3, the strap may include three sections.

Harness strap 7 is attached at one end 75 to the first side section and the other end 76 to the second side section, and is sized to extend around the horse to the back of its head. Ends 75 and 76 may be attached to the side pieces through slots 42 and 52 provided therein as shown in FIG. 2, or through an interconnection such as pin clips 43 and 53 in FIG. 3.

Various interconnecting arrangements between the side pieces 4 and 5 by the control line 6 may be used. As shown in FIG. 2, the a pair of holes 44 may be provided through the first side piece 4, and another pair of holes 54 in the second side piece 5. The first end 61 of control line 6 is enlarged to prevent passage through one of holes 44. This enlarged end which may be a knot made proximate end 61. Alternatively, as shown in FIG. 3, a single grommet 55 may be formed in or attached to the second side piece, and a stop 62 may be attached proximate end 61 of control line 6. Further, control line 6 may also be divided into connected sections through a line clip 63.

It is to be understood that the present invention is not limited to the any single embodiment described above, but encompasses any and all embodiments within the scope of the following claims.

What is claimed is:

1. An control halter for taming an animal through lateral pressure applied to a nose and teir bone of the animal, said control halter comprising:

a first side piece having a nose engaging portion;

a second side piece having a nose engaging portion;

a resilient bridging member between said first side piece and said second side piece, said bridging member biasing said first side piece to a position away from said second side piece;

a control line interconnecting said first side piece and said second side piece distal said bridging member;

such that pull applied to said control line urges said second side piece towards said first side piece against said biasing of said bridging member.

2. The control halter according to claim 1 wherein: said control line includes a first end and second end; said first end secured to said first side piece distal said bridging member; said second end looped through said second side piece distal said bridging member, back through said first side piece, and extending therefrom; such that tension applied to said control line by pulling said second end urges said second side piece towards said first side piece.

3. The control halter according to claim 1, wherein said resilient bridging member is selected from an arched spring wire and an arched spring band.

4. The control halter according to claim 1, wherein said first side piece and said second side pieces are wooden blocks attached to said bridging member in an outwardly bowing configuration, and said nose engaging portions are inward protrusions.

5. The control halter according to claim 1, further comprising a harness strap attached at one end to said first side piece and at the other end to said second side piece such that said nose engaging portion of said first side piece and said nose engaging portion of said second side piece are disposed on opposing sides of the animals nose proximate its tear bone; said harness strap forming a loop sized to engage the back of the animal's head.

6. The control halter according to claim 5, wherein said harness strap includes multiple strap sections; at least one of said strap sections adjustably secured to at least one other of said strap sections.

7. The control halter according to claim 6, wherein one of said strap sections includes a fastener and another of said strap sections includes a plurality of fastening positions for said fastener.

8. The control halter according to claim 7, wherein said fastener is a buckle, and said plurality of fastening positions is provided by a series of buckle holes.

* * * * *